US005203134A

United States Patent [19]

Sorenson et al.

[11] Patent Number: 5,203,134

[45] Date of Patent: Apr. 20, 1993

[54] PIVOTAL FRAME CONNECTOR

[75] Inventors: Gary R. Sorenson, Lakeville; Philip C. Gerberding, Hopkins, both of Minn.

[73] Assignee: Skyline Displays, Inc., Burnsville, Minn.

[21] Appl. No.: 935,649

[22] Filed: Aug. 26, 1992

Related U.S. Application Data

[63] Continuation of Ser. No. 758,751, Sep. 12, 1991.

[51] Int. Cl.[5] ..... E04H 12/18

[52] U.S. Cl. ..... 52/646; 52/109; 403/172

[58] Field of Search ..... 52/109, 71, 585, 646, 52/645, 648, 652; 16/224, 261, 262, 263; 248/166, 167; 211/182; 40/610; 403/172, 176

[56] References Cited

U.S. PATENT DOCUMENTS 4,522,008 6/1985 Zeigler ..... 52/646
4,627,210 12/1986 Beaulieu ..... 52/646
4,658,560 4/1987 Beaulieu ..... 52/646

OTHER PUBLICATIONS

"Tower set up instructions"; Skyline Displays, Inc., 1987.

*Primary Examiner*—David A. Scherbel
*Assistant Examiner*—Matthew E. Leno
*Attorney, Agent, or Firm*—Palmatier, Sjoquist & Helget

[57] ABSTRACT

A pivotal frame connector or pivotal coupler for pivotally attaching two adjacent display structures wherein each of the display structures includes a skeletal frame formed of a network of elongate support rods joined by hub assemblies which provide for articulation of the support rods. The pivotal frame connector includes ends identical in structure to the ends of the support rods to engage those hub assemblies disposed on the periphery of the display frames. These peripheral hub assemblies have empty unused sockets to which the pivotal frame connector is readily attached. The pivotal frame connector is U-shaped and substantially shorter in length than each of the support rods to remain out of sight and out of the way when the display frame is covered by a skin-like aesthetic covering.

11 Claims, 1 Drawing Sheet

PIVOTAL FRAME CONNECTOR

This is a continuation of U.S. patent application Ser. No. 07/758,751, filed Sep. 12, 1991.

BACKGROUND OF THE INVENTION

The present invention relates to connectors for collapsible display structures and, more particularly, to connectors permitting the pivotal movement of adjacent display structures.

A display structure is a structure typically utilized at a trade show convention as a backdrop to a trade show booth to display the goods or services of a company. The display structure may include an aesthetic covering stretched over a frame.

One of the various types of display structures includes a skeletal frame with a network of support rods. The ends of the support rods are interconnected by hub assemblies which provide for articulation of the support rods relative to each other for collapsing the structure for transport, and which also provide for locking of the support rods relative to each other to hold the structure in its erected form on the convention floor. A skin-like covering is typically placed over the frame to provide the appearance of a solid backdrop. Examples of display structures and hub assemblies are illustrated in U.S. Pat. Nos. 3,838,703; 3,968,808; 4,026,313; 4,276,726; 4,280,521; 4,290,244; 4,471,548; and 4,627,210.

These display structures have a number of advantageous attributes. For example, the structures are typically light in weight, and may be carried in one piece to be easily positioned by one person to the desired location in the trade show booth. Moreover, the structures may be formed to reflect a curved or flat appearance. Furthermore, the skeletal frames of the structures are sufficiently strong to provide for lighting, headers, or shelves to be hung therefrom to advertise the goods or services.

A disadvantage of such a display structure is that, when erected, the display structure is generally fixed in its erected form. That is, each portion of the display structure is fixed relative to every other portion by the very nature of the scissors-like unfolding arrangement of the network of support rods. Therefore, even base portions of the skeletal frame may not be adjustable relative to each other to account, by way of example, for variances in the elevation or carpeting of the floor of the trade show booth. Likewise, panel portions of the display structure remain fixed relative to each other to limit the types of backdrops that may be formed.

SUMMARY OF THE INVENTION

An object of the present invention is to provide means for swingably affixing two adjacent display structures.

Another object of the present invention is to provide for such swinging means by utilizing the existing hub assemblies of the adjacent display structures.

Another object of the present display structure is to provide for such swinging means which may be disposed in an out-of-the-way fashion to permit one skin-like covering to be laid over both of the adjacent display structures to provide the appearance of one solid backdrop.

A feature of the present invention is a pivotal frame connector that includes ends shaped identically to the ends of the support rods of the frame. Accordingly, the ends of the pivotal frame connector are pivotally engagable in the hub assemblies which are typically utilized for the support rod ends. The ends of the pivotal frame connector are therefore engagable with the empty or unengaged sockets of the peripheral hub assemblies on the edges of the display structures to swingably affix the adjacent display structures to each other.

An advantage of the present invention is that the proprietor of a trade show booth may arrange his or her backdrop in a greater variety of positions.

Another advantage is that the two adjacent display structures may be covered with one skin-like fabric shell to provide the appearance of one solid backdrop.

Another advantage is that two display structures are easily and quickly hingedly connectable.

Another advantage is that the present pivotal frame connector is positioned out of the way and out of sight.

DETAILED DESCRIPTION OF THE PREFERRED EMBODIMENTS

Figure 1:
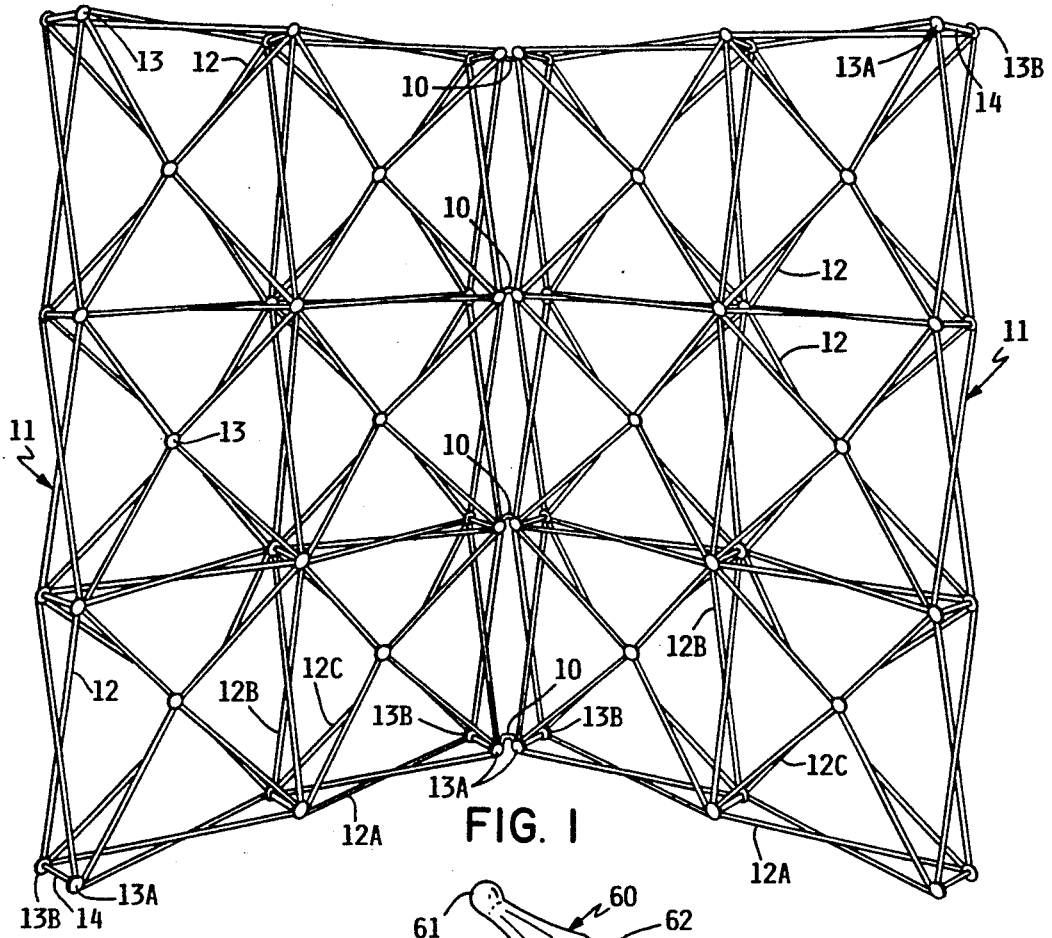
FIG. 1 is an isometric view of a pair of collapsible display structures joined by a set of four pivotal frame connectors.
Figure 3:
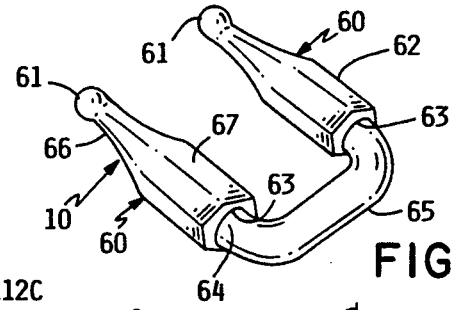
FIG. 3 is an isometric view of one form of the pivotal frame connectors of FIG. 1.

As shown in FIGS. 1 and 3, the present pivotal frame connector is indicated in general by the reference numeral 10. The connector 10 is utilized to swingably connect a pair of adjacent collapsible display structures 11. Each of the display structures 11 includes a skeletal frame formed of a network of support rods 12. The ends of the support rods 12 are joined by a plurality of hub assemblies 13 which permit articulation of the support rods 12 relative to each other. Adjacent or adjoining hub assemblies 13, such as indicated by the reference numerals 13A and 13B, are joined or locked together by a connector rod 14 to fix the adjacent hub assemblies 13 and support rods 12 relative to each other. Hub assemblies 13A, 13B are disposed on respective front and rear faces of each of the display structures 11. When all of the adjacent hub assemblies 13 are fixed by their respective connector rods 14, each portion of each of the display structures 11 is fixed relative to every other portion of its respective display structure 11. The connector rods 14 may be referred to as means for fixing the support rods 12 relative to each other.

Figure 2:
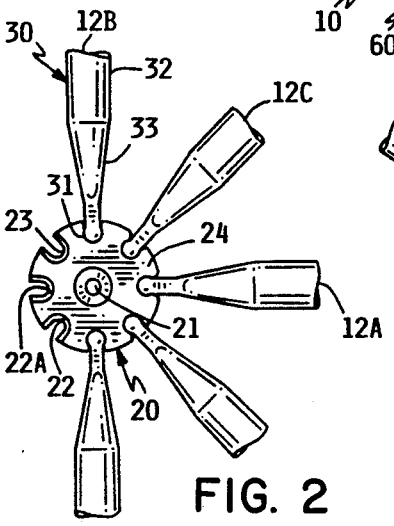
FIG. 2 is an elevation view of a portion of a hub assembly for the collapsible display structures of FIG. 1, and illustrates open socket connections that are available for the pivotal frame connectors of FIG. 1.

Each of the display structures 11 includes support rods radially extending from hub assemblies, as for example support rods **12*a*, 12*b*, and 12*c* as shown in FIG. 2. When in its collapsed form, each of the respective display structures 11 forms a somewhat elongate bundle with the rods 12 extending substantially parallel to each other. As to the display structure 11, the Beaulieu U.S. Pat. No. 4,658,560 is hereby incorporated by reference. As to the hub assembly 13**, the Beaulieu U.S. Pat. No. 4,627,210 is hereby incorporated by reference.

Figure 4:
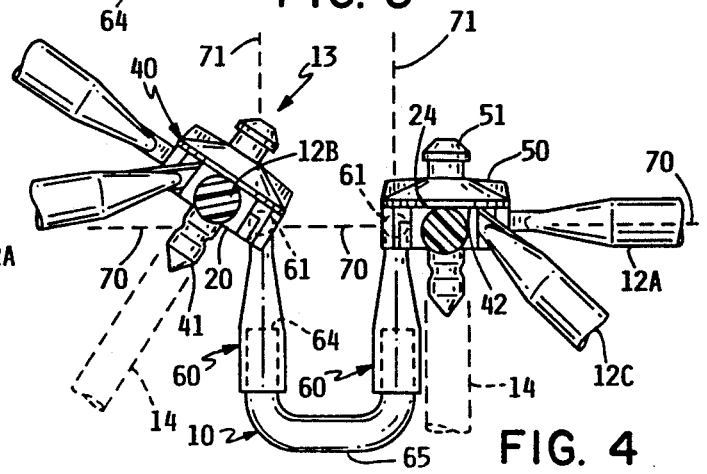
FIG. 4 is a top plan view of two hub assemblies of FIG. 1 pivotally joined by one of the pivotal frame connectors of FIG. 3.

As shown in FIGS. 2 and 4, each of the hub assemblies 13 includes a circular hub body 20 with a central opening 21 and a plurality of sockets or retaining slots or seats 22. Each of the sockets 22 includes shoulders or collars 23. The hub body 20 further includes a confronting face 24.

As shown in FIG. 2, some of the sockets 22 are empty. Such hub assemblies 13 are found along the peripheral edges of each of the display structures 11, and these empty sockets are utilized for engaging the pivotal frame connector 10. Typically, a socket 22A, which is formed radially and horizontally relative to the central opening 21 of the hub assembly body 20, is utilized for engaging the pivotal frame connector 10. Support rod extension caps or engagement means 30 engage circular hub body 20. Each of the caps 30 includes an integral spherical head 31 for engaging one of the sockets 22 and being at least partially retained therein by the collar 23. Each of the caps 30 further includes a hollow end 32 with an opening for sliding over and being fixed to one of the ends of one of the support rods 12. Each of the extension caps 30 further includes an integral tapering portion 33 tapering from the hollow end 32 to the spherical end 31.

As shown in FIG. 4, each of the hub assemblies 13 further includes a locking disk or engagement means 40 with a centrally located bayonet 41 for engaging the central opening 21 of the hub body 20. The circular locking disk 40 includes a face 42 for confronting the top the confronting face 24 of the hub body 20 for locking the spherical heads 31 into a pivotal engagement with the hub assembly 13 after the bayonet 41 has engaged and locked into the central opening 21 of the hub body 20. The bayonets 41 further engage female connector portions of the connector rods 14 to fix adjacent hub assemblies 13 relative to each other.

The circular locking disk 40 further includes a manually grippable handle 50 and a button 51 which is axially aligned with the bayonet 41 and which is typically utilized for attaching structural components to the display structure 11 such as shelving, lights or panels. The handle 50 is typically manipulated when assembling or disassembling the hub assembly 13. A disassembly of the hub assembly 13 may be a partial disassembly where the confronting faces 24 and 42 are drawn away from each other for the insertion or removal of one of the spherical heads 31.

As shown in FIG. 3, each of the pivotal frame connectors 10 includes a pair of extension caps 60, each of which is identical in structure to the extension cap 30. That is, each of the extension caps 60 includes an integral spherical head 61 for engaging one of the sockets 22 and being at least partially retained therein by the collar 23. Each of the caps 60 further includes a hollow end 62 with an opening 63 for sliding over and being fixed to one of the ends 64 of a rigid generally U-shaped rod 65. Each of the extension caps 60 further includes an integral tapering portion 66 tapering from the hollow end 62 to the spherical head 61. It should be noted that the outer surface of hollow portion 62 includes six flat faces 67 to be somewhat hexagonal for engagement by a hand or tool.

An alternative form of pivotal frame connector 10 may be constructed from a single molded part. In this form, the spherical heads 61, the caps 60, and the U-shaped rod 65 are all formed together, preferably in a molding process. The U-shaped configuration is preserved, although departures may be made from the precise configuration shown in FIG. 3.

As shown in FIGS. 2 and 4, spherical heads 31 and 61 are retained in the sockets 22 in like manner. However, while the extension caps 30 are fixed relative to the hub assemblies 13 when the adjacent hub assemblies 13 are fixed to each other via the connector rods 14, the extension caps 60 remain pivotal at substantially all times relative to the hub assemblies 13. Accordingly, the adjacent display structures 11 are swingable relative to each other when erected.

As shown in FIG. 4, a pair of x and y axes are denoted by reference numerals 70 and 71, respectively, and each of the display structures 11 is swingable for at least 90° relative to its respective pair of x and y axes. An x axis or base line 70 intersects both of the spherical heads 61 of the pivotal frame connector 10. A y axis 71 may be defined as a longitudinal axis of each of the extension caps 60. Each of the display structures 11 is swingable to its respective y axis 71 to confront each other as well as being swingable away from each other to be disposed in line with one another along their common x axis 70.

In operation, the hub assemblies 13 located along the inner sides of the display structures 11 to be hingedly connected are at least partially disassembled when the display structures 11 are in their collapsed, non-tensioned forms. These hub assemblies 13 to be disassembled are disposed, when the display structures 11 are erected, in a column-like form on the front face of each of the display structures 11 and along the inner, peripheral, vertical edge of the front face of each of the display structures 11. The spherical heads 61 of each of the pivotal frame connectors 10 is then engaged with respective adjacent, at least partially disassembled, hub assemblies 13 of the display structures 11. The empty sockets 22A, which are engaged by the spherical heads 61, are formed radially and horizontally relative to central opening 21 and are disposed diametrically opposite to the sockets 22 which are engaged by the extension caps 30 of the horizontally extending support rods 12A. After the empty sockets 22A have been engaged by the spherical heads 61, the hub assemblies 13 are reassembled and the display structures 11 are subsequently erected.

After the display structures 11 have been erected, the display structures 11 are swingable relative to each other. Each of the display structures 11 is swingable for at least 90° between its x and y axis 70 and 71 such that the faces of the display structures 11 may confront each other, or such that the display structures 11 lie generally in one line.

It should be noted that after the display structures 11 have been erected, the pivotal frame connectors 10 are tucked away between the front and rear faces of the display structures 11. Hence, a skin-like covering may be placed over the display structures 11 to conceal the network of support rods 12 as well as the pivotal frame connector 10. Even if such a skin-like covering is disposed over the adjacent display structures 11, the display structures 11 remain swingable relative to each other.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. The combination of at least one pivotal frame connector with a pair of collapsible display structures for swingably joining the collapsible display structures, the combination comprising:

a) at least the pair of collapsible display structures, each of the structures comprising:
   1) a skeletal frame comprising a network of support rods, each of the rods comprising a a pair of ends; and
   2) a plurality of hub assemblies for coupling to the support rods and for providing for articulation therebetween, each of the hub assemblies comprising:
      i) a hub body having a plurality of regularly-arranged recesses about a circumference for receiving support rod ends; and
      ii) engagement means connectable to the hub body for pivotally engaging the ends of the support rods in respective recesses and including means for fixing the support rods relative to each other; and b) said at least one pivotal frame connector extending between one of the hub assemblies of each of the collapsible display structures, the pivotal frame connector comprising a pair of ends for engaging the engagement means of one of the hub assemblies of each of the display structures, the ends of the pivotal frame connector received in respective ones of said recesses in said hub body; the at least one frame connector being pivotal independently of the support rods whereby the display structures are swingable relative to each other even when the support rods are fixed relative to each other.

2. The combination of claim 1, wherein the engagement means includes a ball/socket arrangement disposed between the support rods and the hub body and between the pivotal frame connector and the hub body.

3. The combination of claim 1, wherein the rod ends each further comprises a first extension cap with a first spherical head disposed on each of the ends of the support rods, and said recesses further comprise a plurality of sockets formed in a periphery of each of the hub bodies for engaging the first spherical heads, and wherein the pivotal frame connector further comprises a pair of second extension caps with second spherical heads, each of the second extension caps disposed on one of the ends of the pivotal frame connector and also being engageable in said sockets.

4. The combination of claim 3, wherein each of the second extension caps includes a hollow portion which engages its respective end of the pivotal frame connector.

5. The combination of claim 3 and one of the sockets of each of the hubs formed radially and horizontally relative to a center of the hub assembly, wherein each of the second spherical heads of the extension caps of the pivotal frame connector engages one of the sockets formed radially and horizontally relative to the center of the hub assembly.

6. The combination of claim 1, wherein the pivotal frame connector is formed generally in the shape of a U and with a length substantially shorter than each of the support rods.

7. The combination of claim 3 and the hub bodies having an opening, wherein the engagement means of each of the hub assemblies further comprises a locking piece which comprises a locking periphery approximately the size of the periphery of the hub body and a bayonet disposed inwardly of the locking periphery and adapted for reception into and engagement with the opening of the hub body to lock the ends of the support rods and pivotal frame connector in their respective sockets.

8. The combination of claim 1, wherein each of the display structures comprising an edge and a column of hub assemblies disposed adjacent to the edge, each of the hub assemblies of each of the columns engaging one of the pivotal frame connectors.

9. The combination of claim 1 and each of display structures further comprising pairs of adjoining hub assemblies disposed opposite of one another and connectable to each other by a connector rod, the support rods being substantially nonswingable relative to their respective hub assemblies and each of the display structures being noncollapsible when the adjoining hub assemblies are connected by their respective connector rods, wherein each of the pivotal frame connectors remains pivotally engaged in each of its respective hub assemblies when the adjoining hub assemblies are fixed to each other by their respective connector rods.

10. The combination of a pivotal frame connector with a pair of collapsible display structures for pivotally joining the collapsible display structures, the combination comprising:

a) at least the pair of collapsible display structures, each of the structures comprising:
   1) a skeletal frame comprising a network of support rods, each of the rods comprising a pair of support rod ends; and
   2) a plurality of hub assemblies for coupling to the support rods for providing for articulation therebetween, each of the hub assemblies comprising:
      i) a hub body having a hub periphery and an opening;
      ii) a plurality of sockets arranged about the hub periphery;
      iii) a plurality of first extension caps, each of the first extension caps comprising an integral spherical head for pivotally engaging one of the sockets and a first seat in which one of the support rod ends is fixed; and
      iv) a locking disc comprising a locking periphery approximately the size of the hub periphery and a bayonet disposed inwardly of the locking periphery for engagement with the opening of the hub body to lock the first extension caps in their respective sockets; and b) at least one pivotal frame connector extending between and engaging one of the hub assemblies of each of the display structures, the pivotal frame connector comprising a pair of second extension caps, each of the second extension caps comprising an integral spherical head for pivotally engaging one of the sockets and a second seat opposing its respective spherical head, the pivotal frame connector further comprising rigid means disposed between the second seats for being engaged in the second seats and for fixing the second extension caps in a fixed position relative to each other, the rigid means having a length substantially shorter than each of the support rods whereby the pair of collapsible display structures are pivotally connected.

11. The combination of claim 10, wherein the rigid means comprises a U-shaped rod.

* * * * *